US005131344A

United States Patent [19]

Noorman

[11] Patent Number: 5,131,344

[45] Date of Patent: Jul. 21, 1992

[54] MAST FOR SAILBOATS AND THE LIKE

[76] Inventor: Hilbert Noorman, Zomerdijk, NL-7946 LZ Wanneperveen, Netherlands

[21] Appl. No.: 667,431

[22] Filed: Mar. 11, 1991

[30] Foreign Application Priority Data

Mar. 13, 1990 [DE] Fed. Rep. of Germany ..... 4007951

[51] Int. Cl.[5] ..... B63B 15/00

[52] U.S. Cl. ..... 114/90; 114/39.1

[58] Field of Search ..... 114/89-94, 114/102, 103, 39.1, 39.2, 43, 343; 441/65, 74; 280/810; 52/84

[56] References Cited

U.S. PATENT DOCUMENTS

| | | | |
|---|---|---|---|
| 127,047 | 5/1872 | Griffenberg | 114/90 |
| 601,494 | 3/1898 | Clapham | 114/90 |
| 986,258 | 3/1911 | Yost | 114/89 |
| 2,519,230 | 8/1950 | Crankshaw | 114/90 |
| 3,415,215 | 12/1968 | Plym | 114/90 |
| 3,724,412 | 4/1973 | Blecker | 114/90 |
| 3,835,804 | 9/1974 | Jackson | 114/90 |
| 4,072,121 | 2/1978 | Anderson | 114/90 |
| 4,230,060 | 10/1980 | McCoy | 114/90 |
| 4,909,170 | 3/1990 | Smart | 114/90 |

FOREIGN PATENT DOCUMENTS

| | | | |
|---|---|---|---|
| WO88/03889 | 6/1988 | PCT Int'l Appl. | 114/90 |

*Primary Examiner*—Joseph F. Peters, Jr.
*Assistant Examiner*—Clifford T. Bartz
*Attorney, Agent, or Firm*—Peter K. Kontler

[57] ABSTRACT

A mast for use in sailboats and other sail-propelled craft has two elongated solid or hollow sections with confronting at least partially concave internal surfaces, and a plurality of transversely extending crosspieces between the internal surfaces. If the sections are hollow, they can be at least partially filled with foamed polyurethane and/or with elongated wooden or metallic tubes.

22 Claims, 3 Drawing Sheets

MAST FOR SAILBOATS AND THE LIKE

BACKGROUND OF THE INVENTION

The invention relates to improvements in masts for sailboats, for wheel-mounted or skid-mounted vehicles which travel on ice, or for any other type of sail-propelled craft. The following description will refer primarily to sailboats (i.e., to sail-propelled watercraft) with the understanding, however, that the mast of the present invention can be used with equal or similar advantage in all kinds of sail-bearing sail-propelled craft for use on water, on ice or on the ground.

British Pat. No. GB 2 037 686 A discloses a composite mast which comprises two elongated sections and a plurality of transversely extending crosspieces or traverses between the sections. Each section has a substantially drop-shaped or tear-shaped cross-sectional outline in order to reduce resistance which is offered by air when the craft is in motion on water. A drawback of the patented mast is that its stability is not entirely satisfactory, especially if a sailboat utilizing the patented mast is to be manipulated in strong winds and in rough waters.

OBJECTS OF THE INVENTION

An object of the invention is to provide a novel and improved mast which is sturdier than heretofore known masts.

Another object of the invention is to provide a lightweight mast which can stand strong winds on water, on ice or on the ground.

A further object of the invention is to provide a mast which is designed to encounter a minimum of resistance by the surrounding air and which can be installed on existing sail-propelled conveyances.

An additional object of the invention is to provide an aerodynamic mast which offers pronounced resistance to flexing, bending and/or breaking stresses.

Still another object of the invention is to provide the mast with novel and improved means for coupling it with one or more sails.

A further object of the invention is to provide a lightweight mast which can be assembled of simple and inexpensive components.

An additional object of the invention is to provide a novel and improved method of assembling the above outlined mast.

Another object of the invention is to provide a sail-propelled craft which embodies one or more masts exhibiting the aforediscussed features.

SUMMARY OF THE INVENTION

The invention is embodied in a mast for sail-propelled craft. The improved mast comprises two spaced-apart elongated sections having at least partially concave confronting internal surfaces, and a plurality of crosspieces (e.g., in the form of horizontal plates or panels) which are disposed between the internal surfaces of the two sections. The sections are or can be mirror images of each other with reference to a plane which is located midway between the internal surfaces.

At least one of the sections can consist of longitudinally extending wooden strips or slats.

Alternatively, at least one of the sections can be hollow. The hollow section can include an elongated envelope or skin and a plurality of elongated tubes in the envelope. The envelope can include an inner shell or layer which defines the respective internal surface and an outer shell or layer. The tubes are disposed between the inner and outer shells, and at least one of the tubes can extend into at least one of the inner and outer shells. Furthermore, at least one tube can have a polygonal (particularly a hexagonal) cross-sectional outline. The crosspieces can include marginal portions which abut and conform to the outlines of the tubes.

In lieu of tubes, the at least one section can contain an intermediate layer which consists of or contains a foamed plastic material and is sandwiched between the inner and outer shells or layers. The plastic material can be polyurethane. The at least one section can further comprise a plurality of transverse plate-like or panel-like partitions between the inner and outer shells. Such partitions can be equidistant from one another in the longitudinal direction of the at least one section and define with the inner and outer shells a plurality of compartments for the plastic material. At least some of the partitions can alternate with the crosspieces in the longitudinal direction of the at least one section. For example, the crosspieces can be spaced apart from one another a first distance and the partitions can be spaced apart from each other a second distance less than (e.g., substantially half) the first distance.

The sections have front edges which are spaced apart a first distance, and rear edges which are spaced apart a second distance preferably less than the first distance (e.g., one-third of the first distance).

If the sections are hollow, i.e., if each section includes an elongated envelope, each such section can further comprise a pipe which extends longitudinally of and within the respective envelope along the corresponding front edge.

The upper ends of the two sections can carry a cover which is affixed thereto and extends transversely of the sections. Such mast can further comprise connector means for stationary and mobile components of the craft, and the connector means is or are provided on the cover.

The mast can further comprise coupling devices for a foresail or another sail, and such coupling devices are then provided on the crosspieces. Each coupling device can comprise a sail-engaging portion and a distancing portion between the sail-engaging portion and the respective crosspiece. The distancing portions are preferably connected to the respective crosspieces at the rear or trailing edges of the sections. The coupling devices can further comprise means for pivotally connecting the distancing portions to the respective crosspieces.

The novel features which are considered as characteristic of the invention are set forth in particular in the appended claims. The improved mast itself, however, both as to its construction and the mode of making the same, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
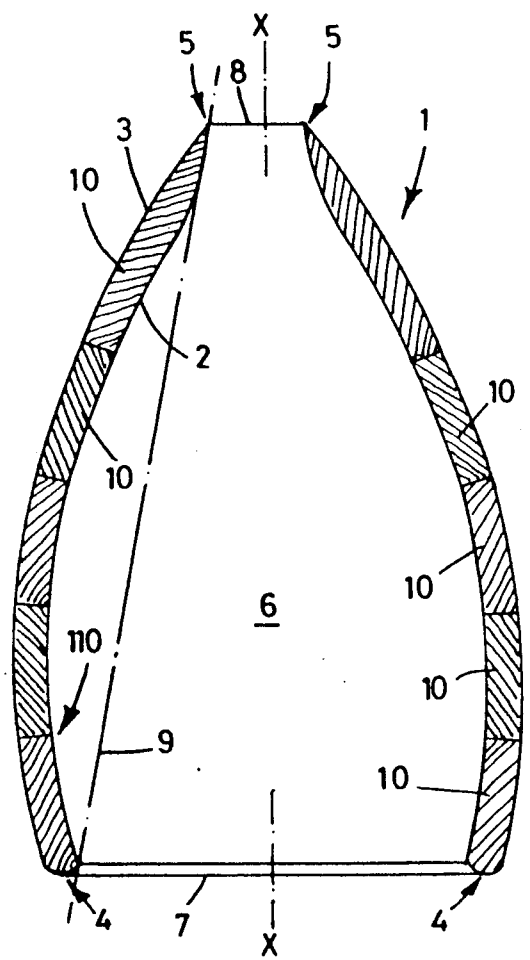
FIG. 1 is a transverse sectional view of a mast which embodies one form of the invention.

FIG. 1 is a transverse sectional view of a mast which embodies one form of the invention and comprises two mirror symmetrical elongated sections 1 which are spaced apart from and are mirror images of each other with reference to a plane X—X which is located midway between their confronting at least partly concave internal surfaces 2. Each section 1 has a convex or partly convex external surface 3 and each of these sections is assembled of a plurality of elongated wooden strips or slats 10. The mast further comprises a plurality of preferably (but not necessarily) equidistant transversely extending plate- or panel-like crosspieces or traverses 6 which are disposed between the internal surfaces 2 of the sections 1 and are configurated to abut the two internal surfaces. Each section 1 has a rounded front edge 4 and a pointed rear edge 5. The front edge face 7 of each crosspiece 6 is located at or slightly behind the front edges 4 of the sections 1, and the rear edge face 8 of each crosspiece is located at the rear edges 5. The crosspieces 6 can be glued and/or otherwise reliably affixed to adjacent portions of the concave or partly concave internal surfaces 2 of the sections 1.

The phantom line 9 denotes in FIG. 1 an imaginary straight line between the front edge 4 and the rear edge 5 of a section 1 or between one end of the rear edge face 8 and the corresponding end of the front edge face 7 of a crosspiece 6. It will be seen that at least the major portion of the line 9 does not cross the left-hand section 1 but primarily or exclusively the crosspiece 6. Thus, the configuration of each internal surface 2 is selected in such a way the corresponding line 9 does not pass through the adjacent section 1. This ensures that each crosspiece 6 takes up pronounced stresses and that the assembled mast of FIG. 1 can stand very large bending or flexing stresses.

The thickness of each section 1 (i.e., the distance from the internal surface 2 to the external surface 3 of each section) is substantially constant save at the rear ends 5 where the sections taper toward the respective ends of the rear edge face 8 of each crosspiece 6. The design of FIG. 1 is particularly advantageous for the assembly of a relatively short mast. The cost is low because each of the two sections merely consists of a number of suitably shaped and finished wooden strips or slats 10 and a small number of crosspieces 6 which can be made of the same material as the sections.

The internal surface or surfaces of one or more strips or slats 10 can be provided with one or more vertical grooves or channels for reception of one or more electric conductors serving to connect one or more light sources on top of the mast with a source of electrical energy. For example, a recess 110 can be provided at the inner sides of and between the two foremost strips 10 of the left-hand and/or right-hand section 1. If the conductor or conductors are made of copper wire which is insulated by one or more layers of lacquer, such conductor or conductors can be inserted into the recess or recesses 110 without any additional insulation, i.e., the layer or layers of lacquer in the recess or recesses between neighboring strips 10 ensure adequate insulation without any additional undertakings.

Figure 3:
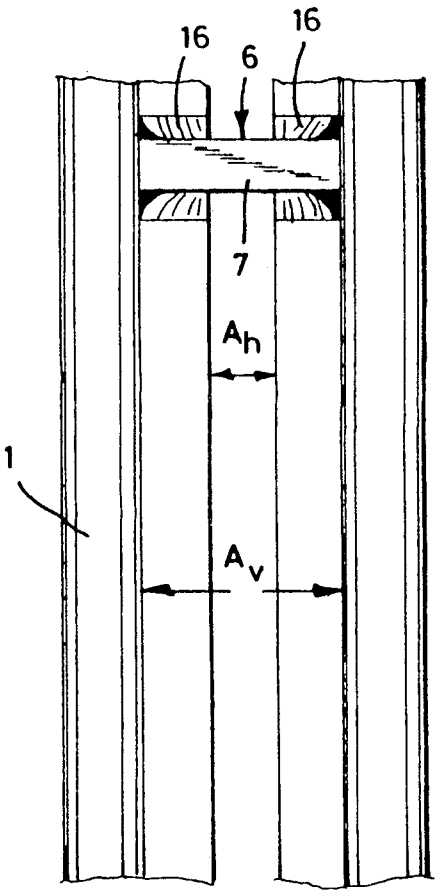
FIG. 3 is a fragmentary front elevational view of the mast which is shown in FIG. 2.
Figure 2:
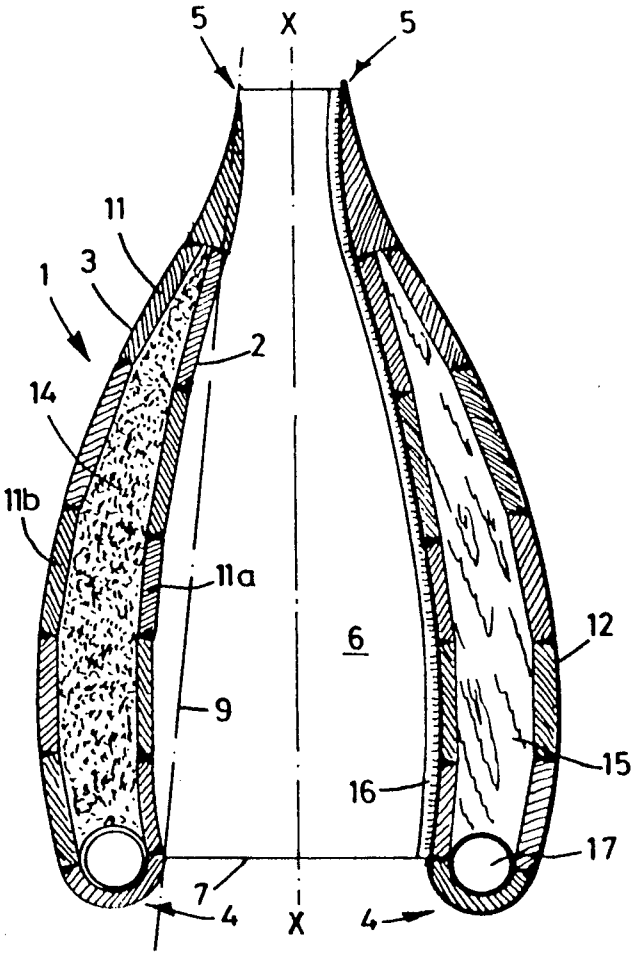
FIG. 2 is a similar transverse sectional view of a modified mast.

FIGS. 2 and 3 show a portion of a modified mast with two mirror symmetrical hollow sections 1 each of which is a sandwich or laminate having an airfoil-shaped envelope or skin 11 with an inner shell or layer 11*a* and an outer shell or layer 11*b*. Each inner shell 11*a* defines the respective concave internal surface 2 and each outer shell 11*b* defines the respective external surface 3. These shells can be made of wood and can be said to constitute the outer layers of a sandwich which further comprises an intermediate layer 14 of foamed plastic material, such as polyurethane. The internal surfaces 2 and/or the external surfaces 3 of the sections 1 are coated with layers 12 of glass fiber reinforced plastic material.

The hollow sections 1 of the mast which is shown in FIGS. 2 and 3 further comprise transversely extending internal partitions 15 which are or can be equidistant from each other (as seen in the longitudinal direction of the respective sections) and each of which can be made of wood or another suitable material. The partitions 15 cooperate with the inner shells 11*a* and outer shells 11*b* of the respective sections 1 to define a number of compartments for the material of the intermediate layer 14. The partitions 15 contribute significantly to stability and rigidity of the hollow sections 1.

The sectional view of FIG. 2 is taken at two different levels, namely at the level of a partition 15 in the right-hand section 1 and at a level between two neighboring partitions 15 in the left-hand section 1. The mutual spacing of neighboring crosspieces 6 (between the at least partly concave internal surfaces 2 of the two sections 1 of FIGS. 2 and 3) is preferably different than that of the neighboring partitions 15 in the two sections. For example, the distribution of crosspieces 6 can be such that each crosspiece is located at the level of a partition 15 in each of the two sections 1 and that a further partition 15 is provided in each section 1 midway or substantially midway between each pair of neighboring crosspieces 6. Thus, the number of partitions 15 in each section 1 can be twice or nearly twice the number of crosspieces 6 between the two sections.

FIG. 3 shows that the transitions 16 between the marginal portions of the crosspieces 6 and the adjacent portions of the two internal surfaces 2 are rounded (concave). This can also be seen in the right-hand portion of FIG. 2. Such concave transitions can be provided by employing a filler of hardenable plastic material or the like.

The front portions of internal spaces of the hollow sections 1 of FIGS. 2 and 3 are empty. Such front portions can receive pipes or hoses 17 for one or more electric cables (not shown) which are used to connect one or more light sources at the top of the mast with a source of electrical energy. The pipes or hoses 17 are adjacent the front edges 4 of the respective hollow sections 1.

FIG. 3 shows that the distance $A_v$ of the two front edges 4 from each other exceeds the distance $A_n$ between the rear edges 5. The ratio of the distances $A_v$ to $A_n$ can be more than two-to-one, e.g., three-to-one.

The upper end portions of the solid sections 1 of FIG. 1 or of the hollow sections 1 of FIGS. 2–3 carry a transversely extending plate-like cover or closure (not shown) which can be provided with eyelets and/or other connectors and/or guide means for deflection or guidance of shrouds (ropes), for the rake of the mainsail, a connector for the foresail and/or for any other movable or fixedly secured parts.

Figure 4:
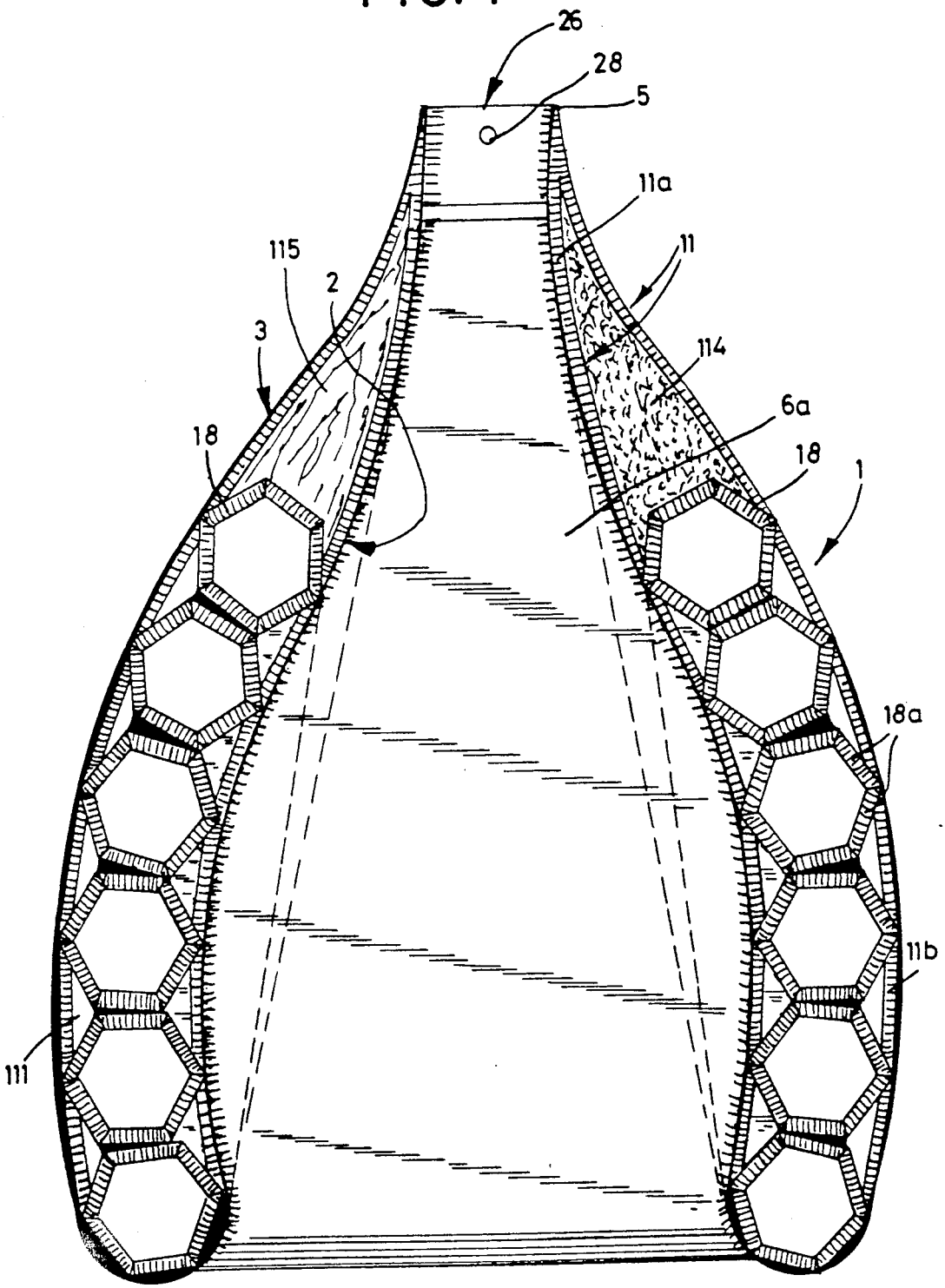
FIG. 4 is a transverse sectional view of a third mast.

FIG. 4 shows a portion of a third mast which has two mirror symmetrical hollow sections 1 resembling those shown in FIG. 2 and containing groups of elongated tubes 18 each having a polygonal (hexagonal) cross-sectional outline. The orientation of tubes 18 in each of the two envelopes 11 is such that one edge of each tube extends into the respective outer layer or shell 11*b* and another edge of each tube extends into the respective inner layer or shell 11*a*. The cross-sectional dimensions of all tubes 18 in a section 1 may but need not be identical. Each intermediate tube 18 in each of the two sections 1 has a first facet which is adjacent a facet of one adjacent tube 18 and a second facet which is adjacent one facet of the other adjacent tube 18. The gaps between such facets of neighboring tubes 18 in a section 1 can be filled with epoxy resin or another suitable bonding material to secure the neighboring tubes to each other and to thus enhance the stability of the sections 1. The gaps between neighboring tubes 18 are rather narrow and diverge in a direction from the respective inner shell 11*a* toward the respective outer shell 11*b*.

Each tube 18 can be assembled of elongated wooden strips 18*a* which are cut to form (e.g., plain) miter joints. The individual strips 18*a* can be secured (e.g., bonded) to a foil (not specifically shown) which is thereupon folded or rolled to convert a set of six coplanar strips 18*a* into a tube 18. A suitable glue can be applied to the locations of miter joints to ensure that the hexagonal cross-sectional outlines of the finished tubes 18 remain intact when the folding or rolling of the foils is completed and the glue has been allowed to set. Of course, it is equally possible to assemble the strips 18*a* into tubes 18 without resorting to a foil and by using nails or other suitable mechanical fasteners in addition to or in lieu of an adhesive substance.

If it is desired to further enhance the rigidity and stability of the sections 1 which are shown in FIG. 4, each tube 18 can be draped into a liner of plastic material or the like, and such liner can form one or more complete convolutions around the respective tube 18. The thickness, stiffness and/or other characteristics of such liner will be selected in dependency on the desired rigidity (e.g., resistance to buckling) of the finished tubes and of the sections 1 which contain such tubes.

It is further within the purview of the invention to employ metallic tubes (e.g., hexagonal tubes of aluminum or another lightweight metallic material) in lieu of or in combination with wooden tubes 18. The stability of wooden and/or metallic tubes can be enhanced by filling some or all of the tubes with a plastic material, e.g., with foamed polyurethane.

That portion of each section 1 which does not contain a tube 18 can contain a set of spaced apart transverse partitions 115 (one shown in the left-hand section 1 of FIG. 4) which perform the same function as the partitions 15 in the sections 1 of FIGS. 2 and 3, namely to define with the respective inner and outer shells 11*a*, 11*b* a row of aligned compartments for a layer 114 of foamed plastic material (shown in the right-hand section 1 of FIG. 4 close to its rear edge 5. The partitions 115 can but need not be located at the levels of the crosspieces 6*a*. The partitions 115 can be made of wood, of a plastic material or of a metallic material.

Each crosspiece 6*a* follows generally the adjacent portions of the two internal surfaces 2 (which are defined by the inner shells 11*a*) but preferably also the outlines of the adjacent portions of the two sets of tubes 18. In other words, the crosspieces 6*a* can include substantially triangular projections or teeth which extend through the inner shells 11*a* and into actual contact with the adjacent facets of the tubes 18 in the two envelopes 11. As can be seen in FIG. 4, the illustrated crosspiece 6*a* has a rear portion with two lateral edge faces which closely follow and can be bonded to the adjacent (slightly convex) rear portions of the two inner shells 11*b*, and a front portion with serrated edge faces which follow the outlines of adjacent portions of the two sets of tubes 18. If the polygonal tubes 18 are replaced with cylindrical tubes, the lateral surfaces of the front portion of each crosspiece 6*a* have an undulate shape to thus ensure that they can closely follow the outlines of adjacent portions of cylindrical tubes.

The elongated spaces 111 between the outer shells 11*b* and the adjacent portions of the tubes 18 are empty; however, it is equally within the purview of the invention to fill the spaces 111 with a plastic or other filler material, e.g., with foamed polyurethane.

One or more electrical conductors can be installed in one or more tubes 18 and/or in one or more spaces 111. It is equally possible to employ the tubes 18 and/or the spaces 111 for guidance of mobile parts, such as shrouds or other cables or ropes.

Figure 6:
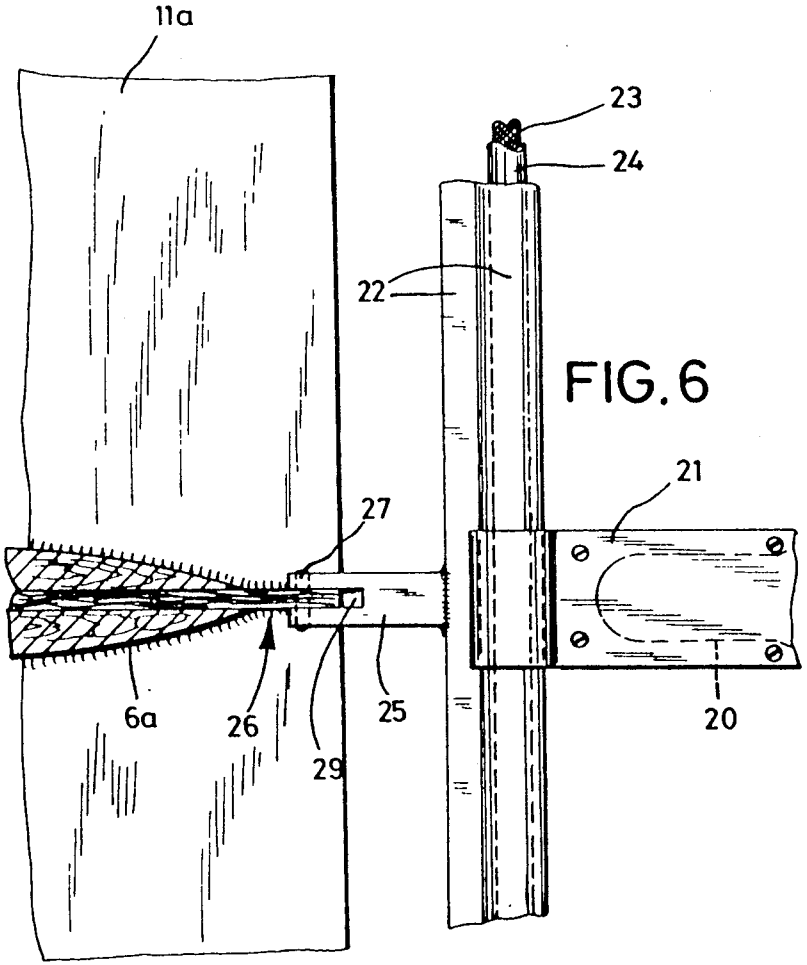
FIG. 6 is a partly elevational and partly sectional view substantially as seen in the direction of arrows from the line VI—VI in FIG. 5.
Figure 5:
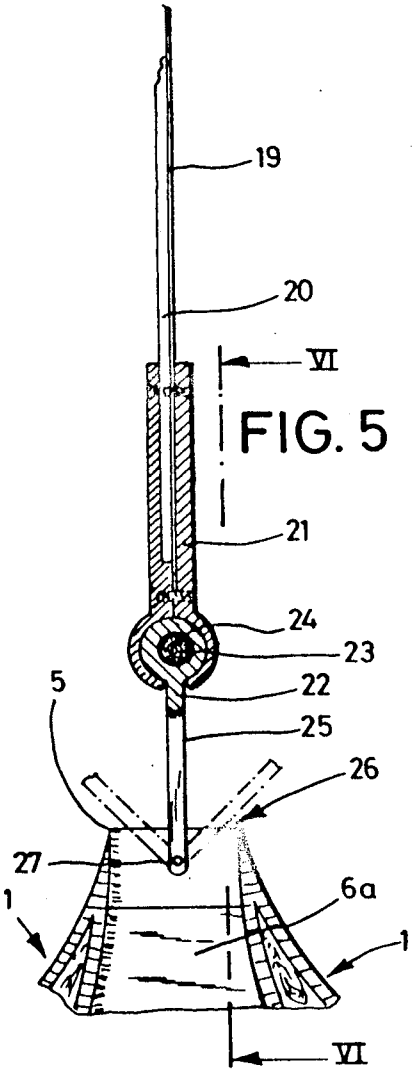
FIG. 5 is a fragmentary transverse sectional view of the third mast and of a device which is used to couple a sail to a crosspiece of the mast.

It is often desirable to rigidly engage and guide the front part of a sail which is to be affixed to the improved mast. Such rigid engagement enhances the desirable aerodynamic characteristics of the craft. This can be achieved by providing one or more crosspieces 6 or 6*a* with coupling devices, e.g., coupling devices of the type shown in FIGS. 5 and 6. The coupling device of FIGS. 5 and 6 is mounted on a crosspiece 6*a* for use in the mast of FIG. 4. For example, the front edge of a sail 19 (e.g., a foresail) can be clamped between the legs of a profiled metallic member which is movably (pivotably) affixed to the rear end portion 26 of the corresponding crosspiece 6*a*. Alternatively, some or all of the crosspieces 6*a* can carry fixedly or movably mounted metallic tongs which engage and clamp the front edge of a sail 19. Still further, it is possible to provide one or more crosspieces 6 or 6*a* with a hook which carries an eyelet for a profiled metallic clamping member which engages the front edge of a sail. One of the purposes of the coupling devices is to prevent portions of the front edge of a sail from bulging or bending away from the rear edges 5 of the sections 1 which, in turn, ensures that the desirable aerodynamic shape of the mast can have an optimum effect upon the attached sail.

FIGS. 5 and 6 show a coupling device which is pivotably secured to the rear end portion 26 of a crosspiece 6*a* in such a way that it can pivot back and forth about a vertical axis (defined by a vertical pin 27 in a hole 28 (FIG. 4) of the rear end portion 26 of the crosspiece 6*a*. The front edge of the sail 19 includes a lath 20 which is received between the legs of a sail-engaging portion or holder 21. The latter surrounds a tubular rear part of a distancing portion 22 which is pivotable about the axis of the pin 27. The distancing portion 22 preferably extends all the way from the top to the lower end of the mast and can be made of a metallic material, e.g., aluminum. The cylindrical rear part of the distancing portion 22 can be reinforced by a steel wire 23 in a plastic sheath 24. At least the rear end portion 26 of the crosspiece 6*a* resembles an airfoil to enhance its aerodynamic properties. The crosspiece 6*a* or its rear end portion 26 can be made of wood, metal or plastic material.

The distancing portion 22 has several extensions or arms 25, e.g., one at the level of each crosspiece 6*a*, and each such arm is pivotally connected to the respective crosspiece 6*a* by a discrete pin 27. Each arm 25 can be integrally connected with the rear part of the distancing portion 22, e.g., by welding. The extent of pivotability of each extension or leg 25 relative to the end portion 26 of the corresponding crosspiece 6*a* can be determined in advance by appropriate dimensioning of the slot 29 in the rear end portion 26. The extension 25 is received in the slot 29 and is held in position by the respective pin 27.

The pivotable coupling device of FIGS. 5 and 6 enables the sail 19 to assume an optimum position with reference to the direction of the wind. Furthermore, the rigid distancing portion 22 of the coupling device maintains the front edge of the sail 19 at a fixed distance from the mast all the way from the top to the lower end of the mast. This renders it possible to use the craft in strong winds because one can take full advantage of the aerodynamic characteristics as well as of the sturdiness of the improved mast. Sturdiness is enhanced by the sections 1 which have at least partially concave internal surfaces 2 and by the crosspieces 6 or 6*a* between such internal surfaces. Sturdiness (particularly the resistance to bending and/or buckling stresses) renders it possible to build a tall mast without risking flexing or breakage by strong winds and/or in rough waters.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A mast for sail-propelled craft, comprising two spaced-apart elongated sections having at least partially concave confronting internal surfaces, at least one of said sections being hollow; and a plurality of crosspieces disposed between said internal surface and spaced apart from each other in the longitudinal direction of said sections.

2. The mast of claim 1, wherein said sections are mirror images of each other with reference to a plane which is disposed midway between said internal surfaces.

3. The mast of claim 1, wherein at least one of said sections consists of longitudinally extending wooden strips.

4. The mast of claim 1, further comprising coupling devices for a foresail, said coupling devices being provided on said crosspieces.

5. The mast of claim 1, wherein said at least one section comprises an elongated envelope and a plurality of elongated tubes in said envelope.

6. The mast of claim 5, wherein said envelope has an inner shell defining the respective internal surface and an outer shell, said tubes being disposed between said shells and at least one of said tubes extending into at least one of said inner and outer shells.

7. The mast of claim 5, wherein at least one of said tubes has a polygonal cross-sectional outline.

8. The mast of claim 7, wherein said outline is a hexagonal outline.

9. The mast of claim 5, wherein said crosspieces include portions which abut and conform to the outlines of said tubes.

10. The mast of claim 1, wherein said at least one section has an inner layer defining said internal surface, an outer layer, and a layer of foamed plastic material sandwiched between said inner and outer layers.

11. The mast of claim 10, wherein said plastic material is polyurethane.

12. The mast of claim 10, wherein said at least one section further comprises a plurality of transverse partitions between said inner and outer layers.

13. The mast of claim 12, wherein said partitions are equidistant from one another in the longitudinal direction of said at least one section and define with said inner and outer layers a plurality of compartments for said plastic material.

14. The mast of claim 12, wherein at least some of said partitions alternate with said crosspieces in the longitudinal direction of said at least one section.

15. The mast of claim 12, wherein said crosspieces are spaced apart from each other a first distance and said partitions are spaced apart from each other a second distance less than said first distance.

16. The mast of claim 15, wherein said second distance is substantially half said first distance.

17. The mast of claim 1, wherein said sections have front edges spaced apart a first distance and rear edges spaced apart a second distance less than said first distance.

18. The mast of claim 1, wherein said sections have upper ends and further comprising a cover affixed to said upper ends, and extending transversely of said sections, and connector means for stationary and mobile components provided on said cover.

19. The mast of claim 1, further comprising coupling devices for a sail, said coupling devices being provided on said crosspieces and each thereof comprising a sail-engaging portion and a distancing portion between the sail-engaging portion and the respective crosspiece.

20. The mast of claim 19, wherein said sections have front and rear edges and said distancing portions are connected with the respective crosspieces at the rear edges of said sections.

21. The mast of claim 19, wherein said coupling devices further comprise means for pivotally connecting said distancing portions to the respective crosspieces.

22. A mast for sail-propelled craft, comprising two spaced apart elongated hollow sections having at least partially concave confronting internal surfaces and neighboring front edges, each of said sections including an elongated envelope and a pipe extending longitudinally of and within the respective envelope along the corresponding front edge; and a plurality of crosspieces disposed between said internal surfaces and spaced apart from each other in the longitudinal direction of said sections.

* * * * *